US012466677B2

(12) United States Patent
Fujii et al.

(10) Patent No.: US 12,466,677 B2
(45) Date of Patent: Nov. 11, 2025

(54) DOCUMENT CONVEYING DEVICE

(71) Applicant: KYOCERA Document Solutions Inc., Osaka (JP)

(72) Inventors: Koji Fujii, Osaka (JP); Takuro Murata, Osaka (JP); Masahiro Nakao, Osaka (JP); Taro Kurahashi, Osaka (JP); Shota Urase, Osaka (JP); Yoshitaka Tokoro, Osaka (JP); Takafumi Nakagawa, Osaka (JP); Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 41 days.

(21) Appl. No.: 18/553,420

(22) PCT Filed: Jun. 22, 2022

(86) PCT No.: PCT/JP2022/024830
§ 371 (c)(1),
(2) Date: Sep. 29, 2023

(87) PCT Pub. No.: WO2023/276806
PCT Pub. Date: Jan. 5, 2023

(65) Prior Publication Data

US 2024/0182254 A1 Jun. 6, 2024

(30) Foreign Application Priority Data

Jun. 28, 2021 (JP) ..... 2021-106730
Jun. 28, 2021 (JP) ..... 2021-106731

(51) Int. Cl.
*B65H 7/04* (2006.01)
*B65H 1/08* (2006.01)

(52) U.S. Cl.
CPC ..... *B65H 7/04* (2013.01); *B65H 1/08* (2013.01); *B65H 2801/06* (2013.01); *B65H 2801/39* (2013.01)

(58) Field of Classification Search
CPC ..... B65H 7/04; B65H 2405/3321; B65H 2405/3322; B65H 2405/332; B65H 2511/15; B65H 43/02; B65H 29/50
See application file for complete search history.

(56) References Cited

U.S. PATENT DOCUMENTS

2019/0263616 A1* 8/2019 Fujiwara ..... B65H 31/02

FOREIGN PATENT DOCUMENTS

| | | |
|---|---|---|
| JP | 2005-008283 A | 1/2005 |
| JP | 2017-024847 A | 2/2017 |
| JP | 2021-066549 A | 4/2021 |

* cited by examiner

*Primary Examiner* — Howard J Sanders
(74) *Attorney, Agent, or Firm* — Studebaker Brackett PLLC

(57) ABSTRACT

A document conveying device (9) includes a sheet feeding tray (44), a discharge tray (43) provided below the sheet feeding tray (44), a feeding roller (51), a conveying mechanism (35), a lifting mechanism (38) which lifts and lowers the sheet feeding tray (44), a discharge tray document sensor (18) which detects the document on the discharge tray (43), and a control part (10) which controls the lifting mechanism (38) such that the document placed on the sheet feeding tray (44) is pressed against the feeding roller (51) when the conveying mechanism (35) conveys the document. The control part (10) controls the lifting mechanism (38) to lower the sheet feeding tray (44) by a larger amount in a case where the document is not detected by the discharge tray document sensor (18) when power is turned on than a case where the document is detected by the discharge tray document sensor (18).

14 Claims, 11 Drawing Sheets

DOCUMENT CONVEYING DEVICE

TECHNICAL FIELD

The present invention relates to a document conveying device which conveys a document to a reading position.

BACKGROUND

In recent years, a request for a large capacity document conveying device provided in a document reading apparatus is increased, and a technology for achieving a large capacity has been studied. For example, Patent Document 1 describes a document feeding device including a lifting means for lifting and lowering a sheet feeding tray and a lifting and lowering control means for lifting the sheet feeding tray according to the feeding of the document from the sheet feeding tray, and configured such that the discharge port of the sheet discharge tray lifts and lowers by the same amount according to the lifting and lowering of the sheet feeding tray.

PRIOR ART DOCUMENTS

Patent Document

Patent Document 1: Japanese Patent Laid-Open No. 2005-8283

SUMMARY OF THE INVENTION

Problems to be Solved by Invention

However, since the document feeding device described in Patent Document 1 is configured to lower the document feeding tray to the lower limit position after the end of the reading of the document, there is a problem in which the document feeding tray may come into contact with the upper surface of the document when a large number of documents is stacked on the discharge tray. In order to remove the documents easily, a space in which the fingers are inserted is preferably formed between the upper surface of the document and the document feeding tray. However, if the lower limit position of the document feeding tray is set higher to secure the space, the capacity of the document feeding tray will be reduced.

In view of the above circumstances, it is an object of the present invention to provide a document conveying device capable of effectively utilizing a capacity of a document feeding tray depending on the presence or absence of documents on a discharge tray.

Means of Solving the Problems

In order to solve the above problem, the document conveying device according to the invention includes: a sheet feeding tray on which a document is placed; a discharge tray provided below the sheet feeding tray; a feeding roller which feeds the document one by one from the sheet feeding tray; a conveying mechanism which conveys the document from the sheet feeding tray to the discharge tray via a reading position; a lifting mechanism which lifts and lowers the sheet feeding tray; a discharge tray document sensor which detects the document on the discharge tray; and a control part which controls the lifting mechanism such that an upper surface of the document placed on the sheet feeding tray is pressed against the feeding roller when the conveying mechanism conveys the document, wherein the control part controls the lifting mechanism to lower the sheet feeding tray by a larger amount in a case where the document is not detected by the discharge tray document sensor when power is turned on than a case where the document is detected by the discharge tray document sensor.

Effects of the Invention

According to the present invention, it becomes possible to utilize the capacity of the sheet feeding tray depending on the presence and absence of the documents on the discharge tray.

BRIEF DESCRIPTION OF DRAWINGS

FIG. 7 is a flowchart showing a main operation of the document conveying device according to the embodiment of the present invention, when the power is turned on.

EMBODIMENT FOR CARRYING OUT THE INVENTION

Hereinafter, with reference to the drawings, a multifunctional peripheral 100 according to one embodiment of the present invention will be described. The multifunctional peripheral 100 includes a printer 1 (an example of an image forming device) and a scanner 8 (an example of a document reading device).

Figure 1:
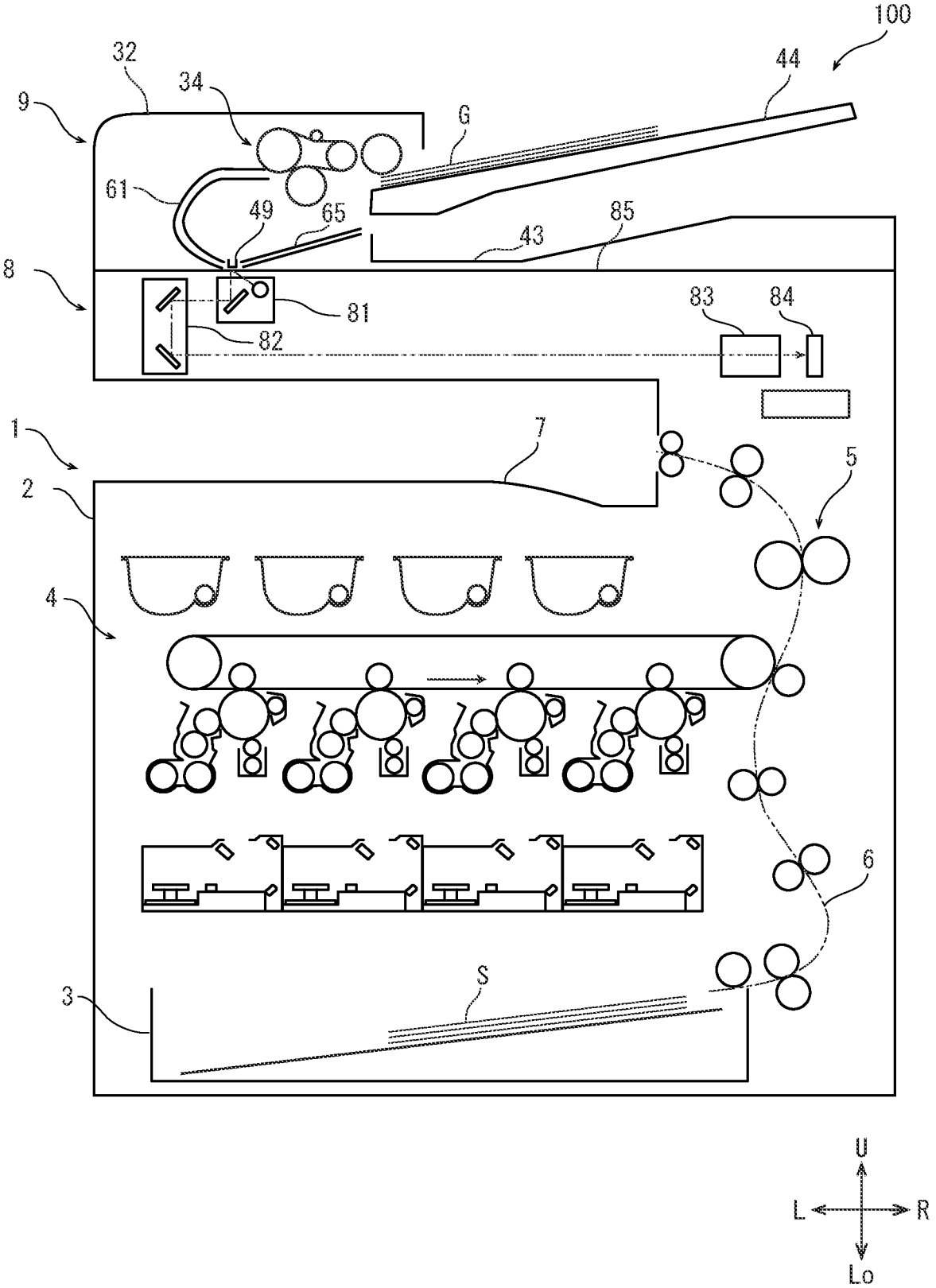
FIG. 1 is a front view schematically showing an internal structure of a multifunctional peripheral according to one embodiment of the present invention.

First, an entire structure of the multifunctional peripheral 100 will be described. FIG. 1 is a front view schematically showing the internal structure of the multifunctional peripheral 100. Hereafter, the front side of the paper plan on which FIG. 1 is drawn is defined as the front side of the multifunctional peripheral 100, and the left-and-right direction is described with reference to the direction in which the multifunctional peripheral 100 is viewed from the front side.

In each drawing, U, Lo, L, R, Fr and Rr indicate the upper, lower, left, right, front and rear, respectively.

The printer 1 includes a rectangular casing 2, and inside the casing 2, a sheet feeding part 3 which feeds a sheet S, an image forming part 4 which forms a full-color toner image by an electrophotographic method, a fixing part 5 which fixes the toner image to the sheet S, and a discharge part 7 which discharges the sheet S are provided. Inside the casing 2, a conveyance path 6 is provided from the sheet feeding part 3 through the image forming part 4 and the fixing part 5 to the discharge part 7.

When the printer 1 receives image data from an external computer or the like, the sheet S is fed from the sheet feeding part 3 to the conveyance path 6, the image forming part 4 forms a toner image on the sheet S, the fixing part 5 fixes the toner image on the sheet S, and the sheet S is discharged to the discharge part 7.

The scanner 8 includes a first carriage 81 with a light source and a reflector, a second carriage 82 with two reflectors, a lens 83 which focuses light, an image sensor 84 which converts the focused light into an image signal, and a contact glass 85 on which the document G is placed.

When the user places the document G on the contact glass 85 and gives a reading instruction to the scanner 8, light is irradiated on the document G from the light source, and the second carriage 82 moves rightward at a speed V/2 in conjunction with the movement of the first carriage 81 rightward at a speed V. The reflected light reflected by the document G is reflected by the reflector of the first carriage 81 and the reflector of the second carriage 82, guided to the lens 83, focused on the image sensor 84, and converted into an image signal. The image signal is output to the printer 1 and converted into the image data.

Figure 2:
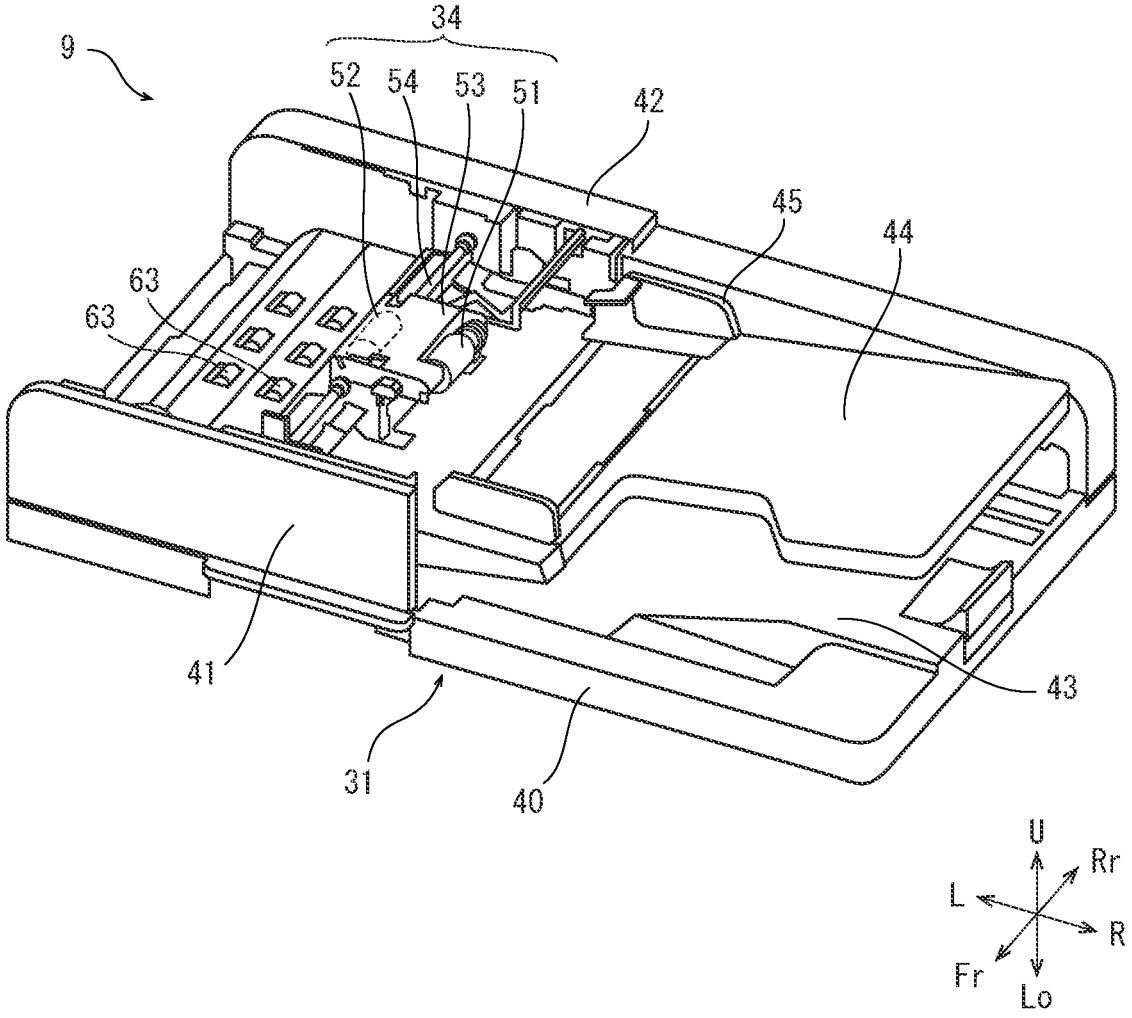
FIG. 2 is a perspective view showing a document conveying device according to the embodiment of the present invention.
Figure 3:
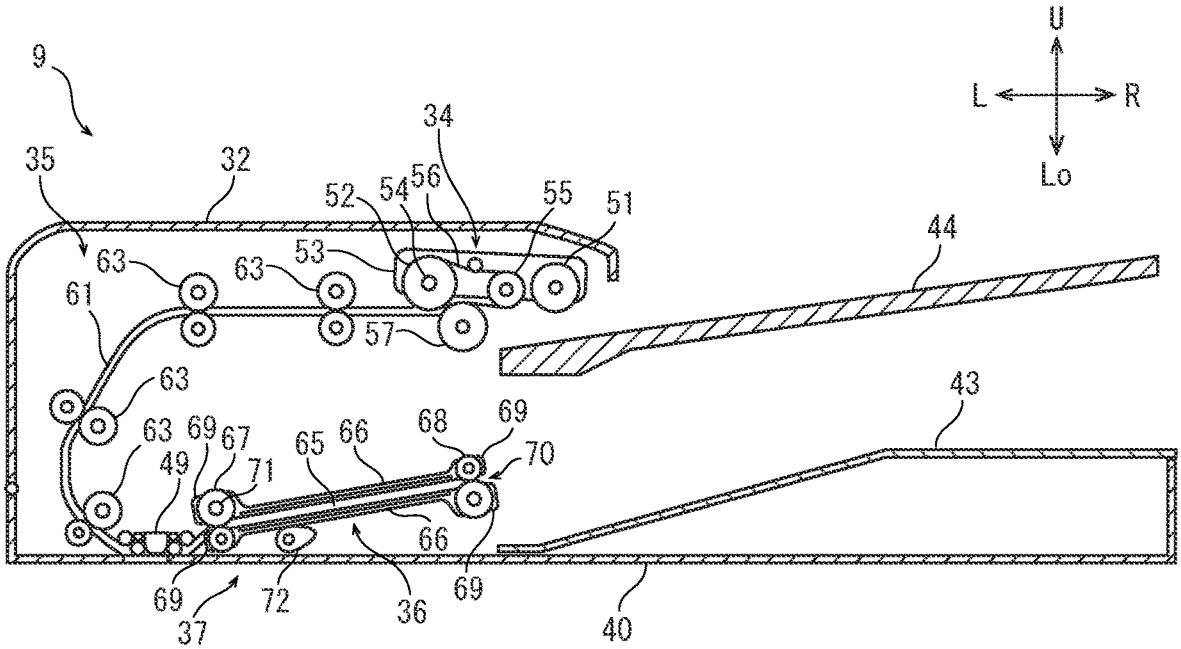
FIG. 3 is a sectional view showing the document conveying device according to the embodiment of the present invention.
Figure 4:
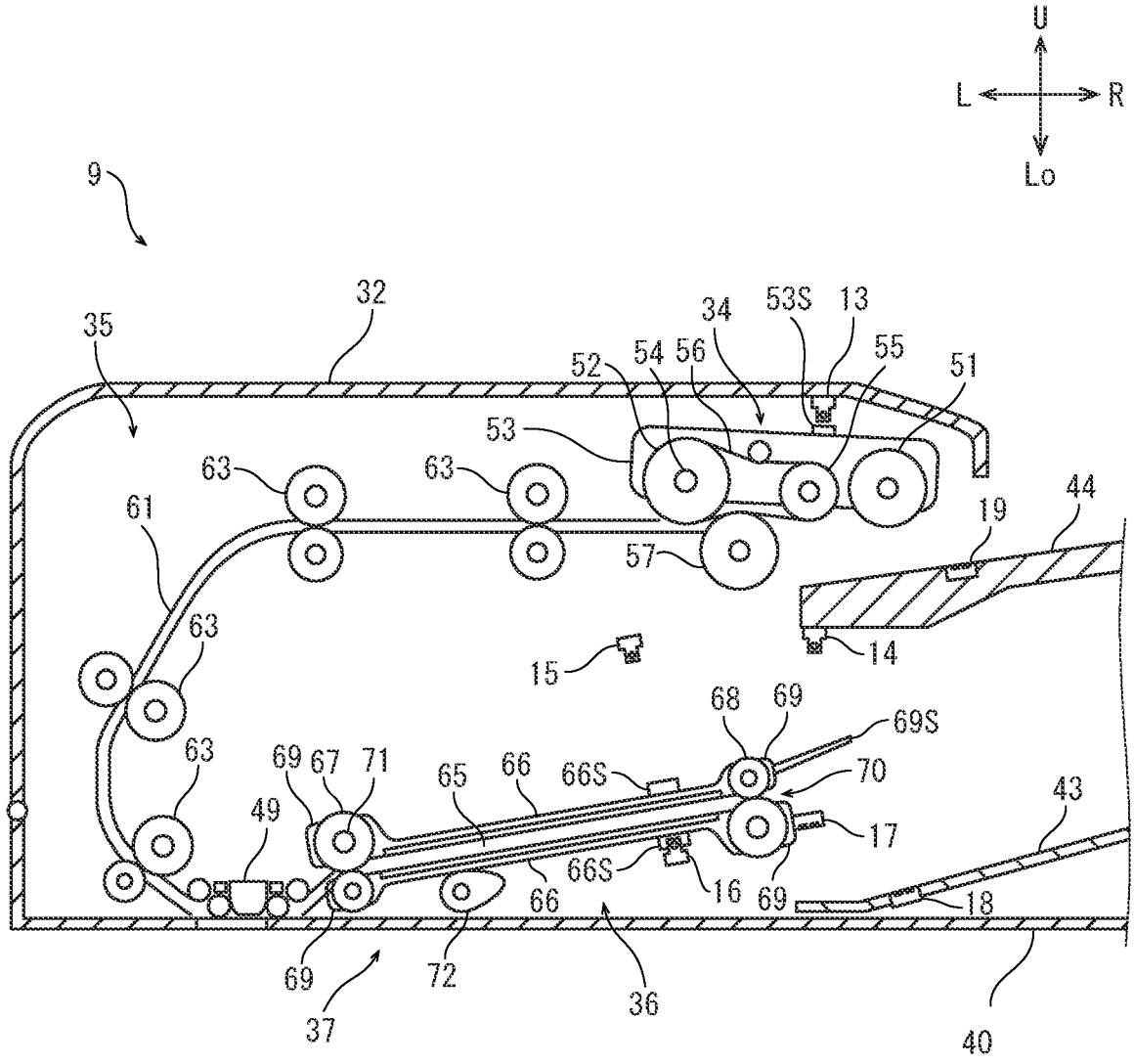
FIG. 4 is a sectional view showing an arrangement of sensors according to the embodiment of the present invention.
Figure 5:
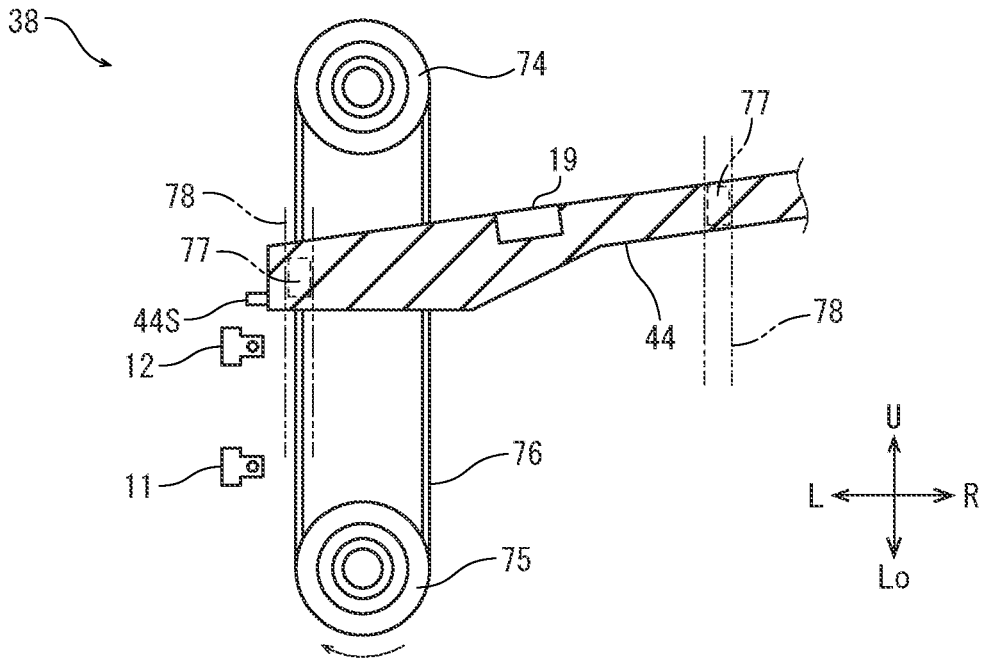
FIG. 5 is a sectional view showing a lifting mechanism and the arrangement of sensors according to the embodiment of the present invention.
Figure 6:
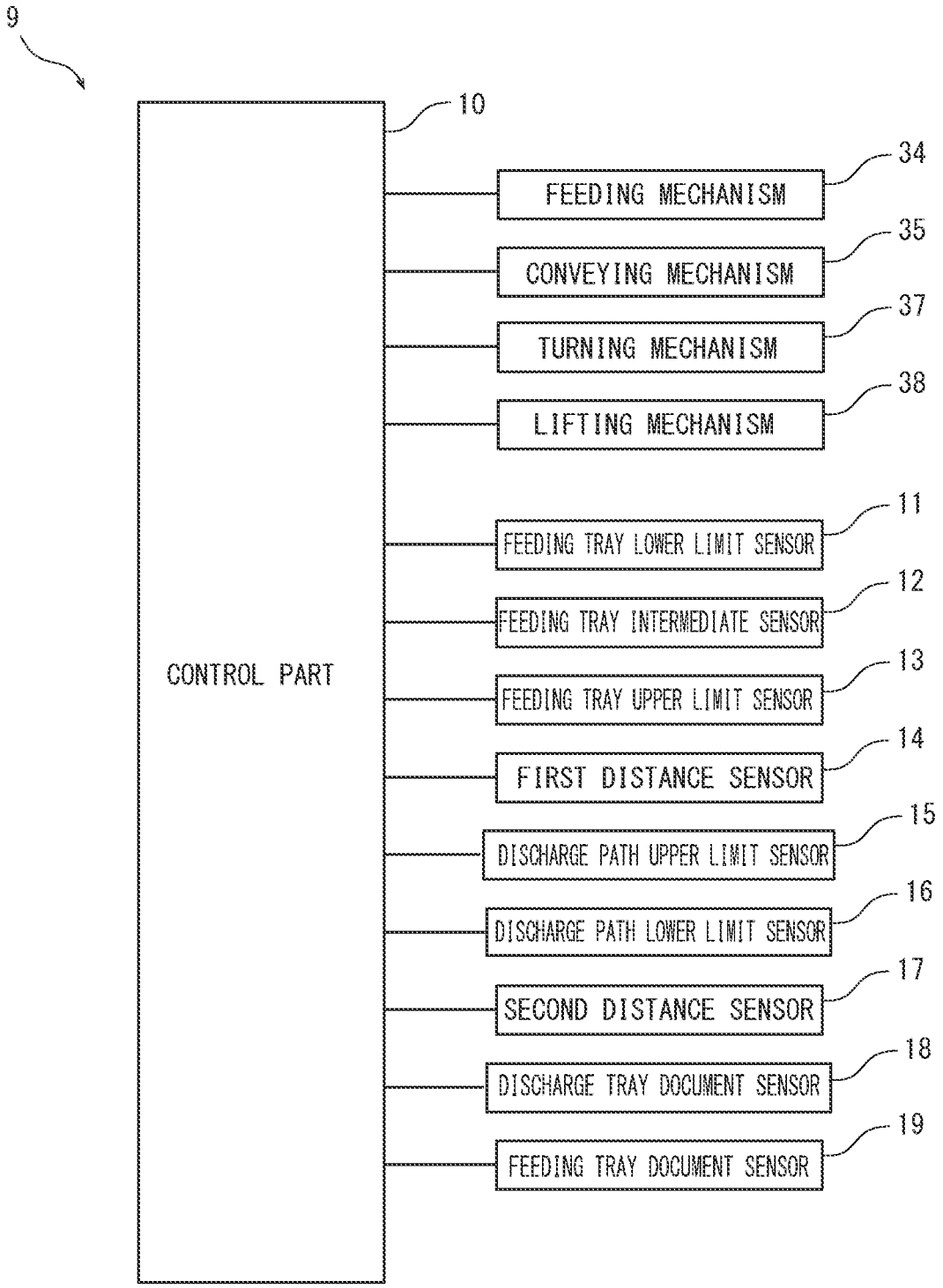
FIG. 6 is a block diagram showing an electrical configuration of the document conveying device according to the embodiment of the present invention.

Next, the configuration of a document conveying device 9 will be described. FIG. 2 is a perspective view showing the document conveying device 9. FIG. 3 is a sectional view showing the document conveying device 9. FIG. 4 is a sectional view showing the arrangement of sensors. FIG. 5 is a front view showing a lifting mechanism 38 and the arrangement of sensors. FIG. 6 is a block diagram showing the electrical configuration of the document conveying device 9. In FIG. 2, a cover 32 (see FIG. 3) is not shown.

The document conveying device 9 includes a sheet feeding tray 44, a discharge tray 43, a sheet feeding roller 51, a conveying mechanism 35, a lifting mechanism 38, a discharge tray document sensor 18, and a control part 10. On the sheet feeding tray 44, a document G is placed. The discharge tray 43 is provided below the sheet feeding tray 44. The sheet feeding roller 51 feeds the document G one by one from the sheet feeding tray 44. The conveying mechanism 35 conveys the document G fed from the sheet feeding tray 44 to the discharge tray 43 via a reading position. The lifting mechanism 38 lifts and lowers the sheet feeding tray 44. The discharge tray document sensor 18 detects the document G on the discharge tray 43. The control part 10 controls the lifting mechanism 38 such that the upper surface of the document G placed on the sheet feeding tray 44 is pushed against the feeding roller 51 when the conveying mechanism 35 conveys the document G. The control part 10 controls the lifting mechanism 38 such that the sheet feeding tray 44 is lowered by a larger amount when the document G is not detected by the discharge tray document sensor 18 when the power is turned on than when the document G is detected by the discharge tray document sensor 18.

[Main Body Part] A main body part 31 (see FIG. 2) has a flat-shaped bottom part 40, and a first wall part 41 and a second wall part 42 that face each other in the front-and-rear direction (in the width direction of the document G intersecting the conveyance direction of the document G). The rear edge portion of the main body part 31 is hinged to the scanner 8 behind the contact glass 85 (see FIG. 1), and the main body part 31 also functions as a presser plate to press the document G on the contact glass 85. The first wall part 41 is provided from the center portion of the front edge portion of the bottom part 40 to the left end portion, and the second wall part 42 is provided throughout the rear edge portion of the bottom part 40.

[Sheet Feeding Tray, Discharge Tray] The discharge tray 43 is provided on the right side portion of the upper surface of the bottom part 40, and the sheet feeding tray 44 is provided above the discharge tray 43 (see FIG. 2 to FIG. 4). The sheet feeding tray 44 is a plate-like member inclined such that its left side is lower, and on its upper surface, a cursor 45 (see FIG. 2) is provided to align the front and rear ends of the document G. A regulation part (not shown) is provided adjacent to the left end portion of the sheet feeding tray 44 to regulate the leftward movement of the placed document G. The discharge tray 43 is inclined such that its left side is lower, and a regulation part (not shown) is provided adjacent to the left end portion of the discharge tray 43 to regulate the leftward movement of the discharged document G.

[Feeding Mechanism] A feeding mechanism 34 is provided in the space between the first wall part 41 and the second wall part 42 (see FIG. 2 to FIG. 4). The feeding mechanism 34 is provided with a box-shaped holder 53 with the lower surface opened, and inside the holder 53, a feeding roller 51, a driven roller 55 provided on the left side of the feeding roller 51, a driving roller 52 provided on the left side of the driven roller 55, a rubber belt 56 stretched around the driving roller 52 and the driven roller 55, and an auxiliary roller 57 pressed against the lower surface of the lower side portion of the belt 56 are provided. The feeding roller 51, the driven roller 55, the driving roller 52 and the auxiliary roller 57 are arranged with their axial directions along the front-and-rear direction.

The feeding roller 51 has a core metal and an elastic layer made of rubber or the like (not shown). The driven roller 55, the driving roller 52 and the auxiliary roller 57 are made of resin or the like. Both front and rear end portions of the drive shaft 54 of the driving roller 52 are supported by the first wall part 41 and the second wall part 42, and connected to a drive source such as a motor (not shown). The holder 53 is supported by the drive shaft 54, and is swingable around the drive shaft 54. The driving force of the drive shaft 54 is transmitted to the feeding roller 51 by a transmission mechanism (not shown) such as a gear train or a timing belt.

[Conveying Mechanism] The conveying mechanism 35 (see FIG. 3 and FIG. 4) includes a conveyance path 61 passing through the reading position, a discharge path 65 connected to the downstream end of the conveyance path 61 in the conveyance direction, a discharge port 70 provided at the downstream end of the discharge path 65 in the conveyance direction, and a turning mechanism 37 which turns the discharge path 65 in the upper-and-lower direction around the upstream end of the discharge path 65 in the conveyance direction.

[Conveyance Path] The conveyance path 61 is formed in a U-shaped curved shape from the feeding mechanism 34 to the upper right side position of the reading position via the reading position. On the conveyance path 61, a plurality of conveyance rollers pairs 63 is provided along the conveyance direction. The reading position is a position facing to the reflector of the first carriage 81 (see FIG. 1) located at the home position. At the reading position, a shading plate 49 is provided (see FIG. 1, FIG. 3 and FIG. 4), and a gap is provided between the shading plate 49 and the contact glass 85 for passing the document G. The scanner 8 reads the document G passing through the reading position.

The conveyance path 61 is formed by plate-like conveyance guide members facing each other with a gap for passing the document G. The conveyance rollers pair 63 includes a driving roller and a driven roller, and the driving roller is connected to a drive source (not shown) such as a motor. An openable and closable plate-shaped cover 32 is provided above the conveying mechanism 35. The left end portion of the cover 32 is hinged to the left end portion of the bottom part 40 of the main body part 31.

[Discharge Path, Discharge Port] A conveyance rollers pair 67 is provided at the upstream end of the discharge path 65 in the conveyance direction, and a discharge rollers pair 68 is provided at the downstream end of the discharge path 65 in the conveyance direction. The discharge path 65 is formed by plate-like discharge guide members 66 facing each other with a gap for passing the document G. The conveyance rollers pair 67 and the discharge rollers pair 68 are supported by roller supports 69 formed vertically at both the front and rear end portions of the discharge guide member 66. The conveyance rollers pair 67 and the discharge rollers pair 68 each includes a driving roller and a driven roller, and the driving roller is connected to a drive source (not shown) such as a motor. In the contact area between the driving roller and the driven roller of the discharge rollers pair 68, a discharge port 70 from which the document G is discharged is formed.

[Turning Mechanism] The turning mechanism 37 includes a turning shaft 71 and an eccentric cam 72. The turning shaft 71 is provided at the upstream end of the discharge path 65 in the conveyance direction with the axial direction along the front-and-rear direction. In this embodiment, the driving shaft of the conveyance rollers pair 67 serves also as the turning shaft 71, but the driven shaft of the conveyance rollers pair 67 may also serve as the turning shaft 71, or the turning shaft 71 separate from the driving shaft and the driven shaft of the conveyance rollers pair 67 may be provided in the discharge guide member 66. The eccentric cam 72 is turnable around a camshaft whose axial direction is along the front-and-rear direction, and is connected to a drive source (not shown) such as a motor. The sliding surface of the eccentric cam 72 is in contact with the lower surface of the lower discharge guide member 66. Due to the turning of the eccentric cam 72, the discharge mechanism 36 is turned around the turning shaft 71.

[Lifting Mechanism] The lifting mechanism 38 (see FIG. 5) includes a driving pulley 74 and a driven pulley 75, and a belt 76 wound around the driving pulley 74 and the driven pulley 75. The lifting mechanism 38 is provided on the front and rear sides of the sheet feeding tray 44, the driving pulley 74 is disposed above the sheet feeding tray 44, and the driven pulley 75 is disposed below the sheet feeding tray 44. The driving pulley 74 is connected to a drive source (not shown) such as a motor.

Two left and right sliding parts 77 are formed on the front and rear edges of the sheet feeding tray 44, and sliding guide parts 78 are formed on the rear surface of the first wall part 41 and on the front surface of the second wall part 42 to guide the sliding parts 77 in the upper-and-lower direction. The sliding part 77 protrudes from the front and rear edges of the sheet feeding tray 44, for example, and the sliding guide part 78 is formed in a groove shape into which the sliding part 77 is fitted. One of the two sliding parts 77 the sheet feeding tray 44 (in this example, the left sliding part 77) is fixed to the belt 76. The belt 76 is driven in the direction of the arrow shown in FIG. 4A to lift the sheet feeding tray 44, and the belt 76 is driven in the opposite direction of the arrow to lower the sheet feeding tray 44.

[Control Part] The control part 10 (see FIG. 6) may be realized by software using a processor or by a logic circuit (hardware) formed in an integrated circuit or the like. When a processor is used, various processes are executed by the processor reading and executing programs stored in memory. As the processor, for example, a CPU (Central Processing Unit) is used. The memory includes storage media such as ROM (Read Only Memory), RAM (Random Access Memory) and EEPROM (Electrically Erasable Programmable Read Only Memory). A control program used to control each part of the multifunctional peripheral 100 is stored in the memory.

[Operation Part] An operation part is provided on the front side of the scanner 8 (not shown). The operation part includes a display panel, a touch panel provided on the display surface of the display panel and a keypad adjacent to the display panel. The control part 10 displays a screen representing the operation menu, status, and the like of the printer 1 and the scanner 8 on the display panel, and controls each part of the printer 1 and the scanner 8 according to the operation detected by the touch panel and keypad.

[Sheet Feeding Tray Lower Limit Sensor] A sheet feeding tray lower limit sensor 11 (see FIG. 5) detects the sheet feeding tray 44 at the lower limit position of the sheet feeding tray 44. The sheet feeding tray lower limit sensor 11 is a transmission type optical sensor (photo-interrupter), and is provided in the second wall part 42. A light-shielding plate 44S protruding leftward and the like is provided at the left end portion of the sheet feeding tray 44 on the side of the second wall part 42. The sheet feeding tray lower limit sensor 11 is provided at a position corresponding to the light-shielding plate 44S when the sheet feeding tray 44 is positioned at the lower limit position.

[Sheet Feeding Tray Intermediate Sensor] A sheet feeding tray intermediate sensor 12 detects the sheet feeding tray 44 at an intermediate position between the lower and upper limit positions of the sheet feeding tray 44. The sheet feeding tray intermediate sensor 12 is a transmission type optical sensor, and is provided on the second wall part 42. The sheet feeding tray intermediate sensor 12 is provided at a position corresponding to the light-shielding plate 44S when the sheet feeding tray 44 is positioned at the intermediate position. The intermediate position is the position below the sheet feeding tray 44, that is, the position of the sheet feeding tray 44 where a space for stacking a predetermined number (for example, 300) of documents G is secured on the discharge tray 43 and a space of a predetermined distance (for example, 10 mm) is secured between the upper surface of the predetermined number of stacked documents G and the lower surface of the sheet feeding tray 44.

[Sheet Feeding Tray Upper Limit Sensor] A sheet feeding tray upper limit sensor 13 (see FIG. 4) detects the sheet feeding tray 44 at the upper limit position of the sheet feeding tray 44. The sheet feeding tray upper limit sensor 13 is a transmission type optical sensor, and is provided on the inner surface of the cover 32. A light-shielding plate 53S protruding upward and the like is provided on the upper portion of the holder 53 of the feeding mechanism 34. As described above, the holder 53 is supported by the drive shaft 54, and is swingable around the drive shaft 54. The control part 10 controls the lifting mechanism 38 to lift the sheet feeding tray 44 on which the document G is placed, and the holder 53 is swung upward when the upper surface of the document G is pressed against the feeding roller 51. When the holder 53 is swung upward by a predetermined amount, the light-shielding plate 53S blocks the light of the sheet feeding tray upper limit sensor 13. At this time, an appropriate load acts between the upper surface of the document G and the feeding roller 51, and the document G can be fed by the feeding roller 51. The position of the sheet feeding tray 44 at this time is called the upper limit position. Therefore, the upper limit position of the sheet feeding tray 44 varies depending on the presence or absence and an amount of documents G on the sheet feeding tray 44.

[First Distance Sensor] A first distance sensor 14 detects that a distance between the sheet feeding tray 44 and the discharge port 70 is the first predetermined distance. For example, the first distance sensor 14 is a transmission type optical sensor, and is provided on the left end portion of the lower surface of the sheet feeding tray 44. A light-shielding plate 69S protruding rightward and the like is provided on the right end roller support 69 of the upper discharge guide member 66. When the sheet feeding tray 44 and the discharge port 70 are separated by the first predetermined distance (for example, 5 mm), the first distance sensor 14 detects the light-shielding plate 69S. The first distance sensor 14 may be a reflective optical sensor.

[Discharge Path Upper Limit Sensor] A discharge path upper limit sensor 15 detects the discharge path 65 at the upper limit position of the discharge path 65. The discharge path upper limit sensor 15 is a transmission type optical sensor, and is provided in the first wall part 41 or the second wall part 42. A light-shielding plate 66S protruding upward and the like is provided in the upper discharge guide member 66. The discharge path upper limit sensor 15 is provided at a position corresponding to the light-shielding plate 66S when the discharge path 65 is positioned at the upper limit position.

[Discharge Path Lower Limit Sensor] A discharge path lower limit sensor 16 detects the discharge path 65 at the lower limit position of the discharge path 65. The discharge path lower limit sensor 16 is a transmission type optical sensor, and is provided in the first wall part 41 or the second wall part 42. A light-shielding plate 66S protruding downward and the like is provided in the lower discharge guide member 66. The discharge path lower limit sensor 16 is provided at a position corresponding to the light-shielding plate 66S when the discharge path 65 is positioned at the lower limit position.

[Second Distance Sensor] A second distance sensor 17 measures a distance between the upper surface of the document G stacked on the discharge tray 43 and the discharge port 70. The second distance sensor 17 is a reflective optical sensor, is provided on the right end roller support 69 of the lower discharge guide member 66 and faces the left end portion of the upper surface of the discharge tray 43. The second distance sensor 17 emits light on the upper surface of the document G stacked on the discharge tray 43, and measures the distance to the upper surface of the document G using the phase difference of the reflected light.

[Discharge Tray Document Sensor] A discharge tray document sensor 18 detects the document G on the discharge tray 43. The discharge tray document sensor 18 is a transmission or reflection type optical sensor, and is provided on the left end portion of the upper surface of the discharge tray 43. The discharge tray document sensor 18 continuously outputs a discharge tray document detection signal indicating the presence or absence of document G on the discharge tray 43 to the control part 10. The value of the discharge tray document detection signal is 0 when document G is not detected and 1 when the document G is detected.

[Sheet Feeding Tray Document Sensor] A sheet feeding tray document sensor 19 detects the document G on the sheet feeding tray 44. The sheet feeding tray document sensor 19 is a reflective optical sensor, and is provided on the left end portion of the upper surface of the sheet feeding tray 44. The sheet feeding tray document sensor 19 continuously outputs a sheet feeding tray document detection signal indicating the presence or absence of the document G on the sheet feeding tray 44 to the control part 10. The value of the sheet feeding tray document detection signal is 0 when the document G is not detected and 1 when the document G is detected.

Figure 7:
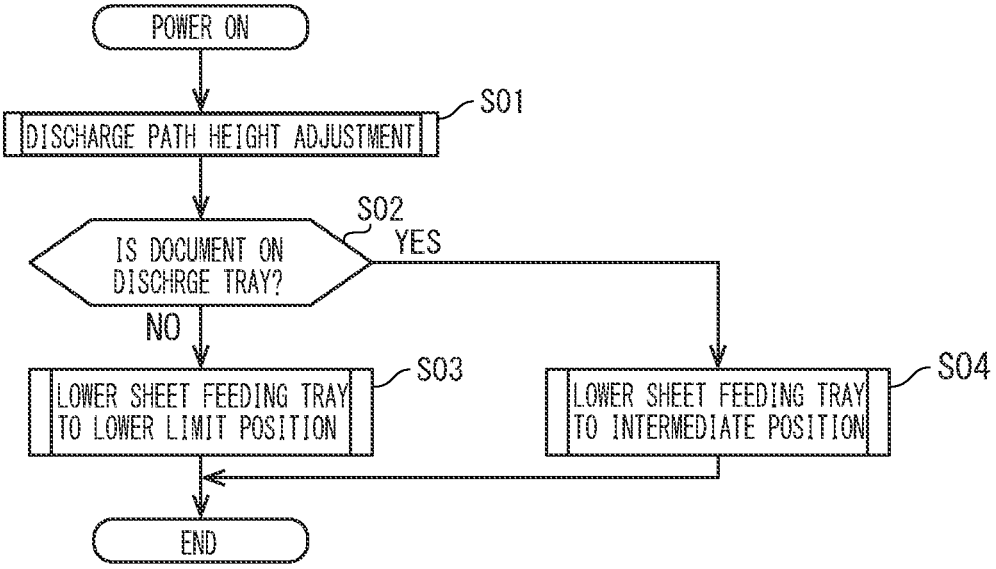

Next, the operation of the document conveying device 9 will be described. FIG. 7 is a flowchart showing the main operation of the document conveying device 9 when the power is turned on. These operations may be performed not only when the power is turned on but also when the document reading job is completed.

First, the control part 10 performs a discharge path height adjustment (step S01). Details of the discharge path height adjustment will be described later. Next, the control part 10 uses the discharge tray document sensor 18 to determine whether there is the document G on the discharge tray 43 (step S02). If the discharge tray document sensor 18 does not detect the document G, the control part 10 determines that there is no document G on the discharge tray 43 (step S02: NO), and lowers the sheet feeding tray 44 to the lower limit position (step S03). On the other hand, when the document G is detected, the control part 10 determines that the document G is on the discharge tray 43 (step S02: YES), and moves the sheet feeding tray 44 to the intermediate position (step S04). Details of steps S03 and S04 will be described later.

Figure 8:
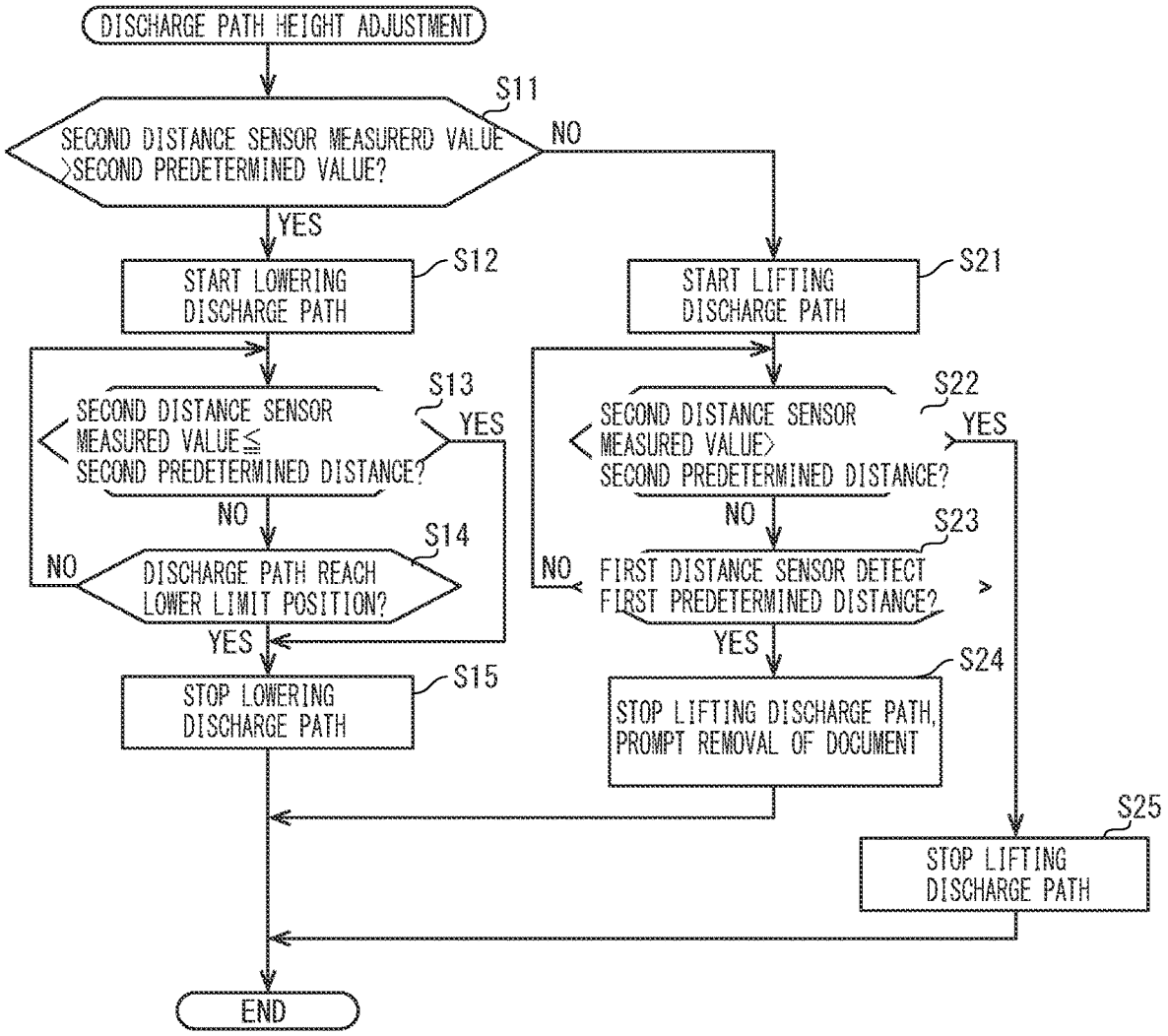
FIG. 8 is a flowchart showing a conveyance path height adjusting operation according to the embodiment of the present invention.

FIG. 8 is a flowchart showing the operation of the conveyance path height adjustment (step S01 in FIG. 7). First, the control part 10 determines whether the measured value of the second distance sensor 17 is larger than the second predetermined distance (for example, 10 mm) (step S11). If it is determined that the measured value is larger than the second predetermined distance (step S11: YES), the control part 10 controls the turning mechanism 37 to start lowering of the discharge path 65 (step S12), and determines whether the measured value of the second distance sensor 17 is equal to or smaller than the second predetermined distance (step S13). When it is determined that the measured value is equal to or smaller than the second predetermined distance (step S13: YES), the control part 10 stops the lowering of the discharge path 65 (step S15), and ends the discharge path height adjustment.

On the other hand, if it is determined that the measured value is not smaller than the second predetermined distance (step S13: NO), the control part 10 uses the discharge path lower limit sensor 16 to determine whether the discharge path 65 reaches the lower limit position (step S14). When it is determined that the discharge path 65 reaches the lower limit position (step S14: YES), the control part 10 stops the lowering of the discharge path 65 (step S15), and ends the discharge path height adjustment. On the other hand, when it is determined that the discharge path 65 does not reaches the lower limit position (step S14: NO), the control part 10 repeats the processing after step S13.

If it is determined in step S11 that the measured value is not larger than the second predetermined distance (step S11: NO), the control part 10 control the turning mechanism 37 to start the lifting of the discharge path 65 (step S21), and determines whether the measured value of the second distance sensor 17 is larger than the second predetermined distance (step S22). When it is determined that the measured value is larger than the second predetermined distance (step S22: YES), the control part 10 stops the lifting of the discharge path 65 (step S25), and ends the discharge path height adjustment.

On the other hand, if it is determined that the measured value is not larger than the second predetermined distance (step S22: NO), the control part 10 uses the first distance sensor 14 to determine whether the distance between the sheet feeding tray 44 and the discharge port 70 is the first predetermined distance (step S23). When it is determined that the distance is the first predetermined distance (step S23: YES), since it is impossible to lift the discharge path 65 further, the control part 10 stops the lifting of the discharge path 65, outputs information to prompt the removal of the documents G from the discharge tray 43 and the sheet feeding tray 44 (step S24), and ends the discharge path height adjustment. The information prompting the removal of the documents G may be displayed on the display panel of the operation part or may be audibly output. On the other hand, when it is determined that the distance is not the first predetermined distance (step S23: NO), the control part 10 repeats the processing after step S22.

Figure 9:
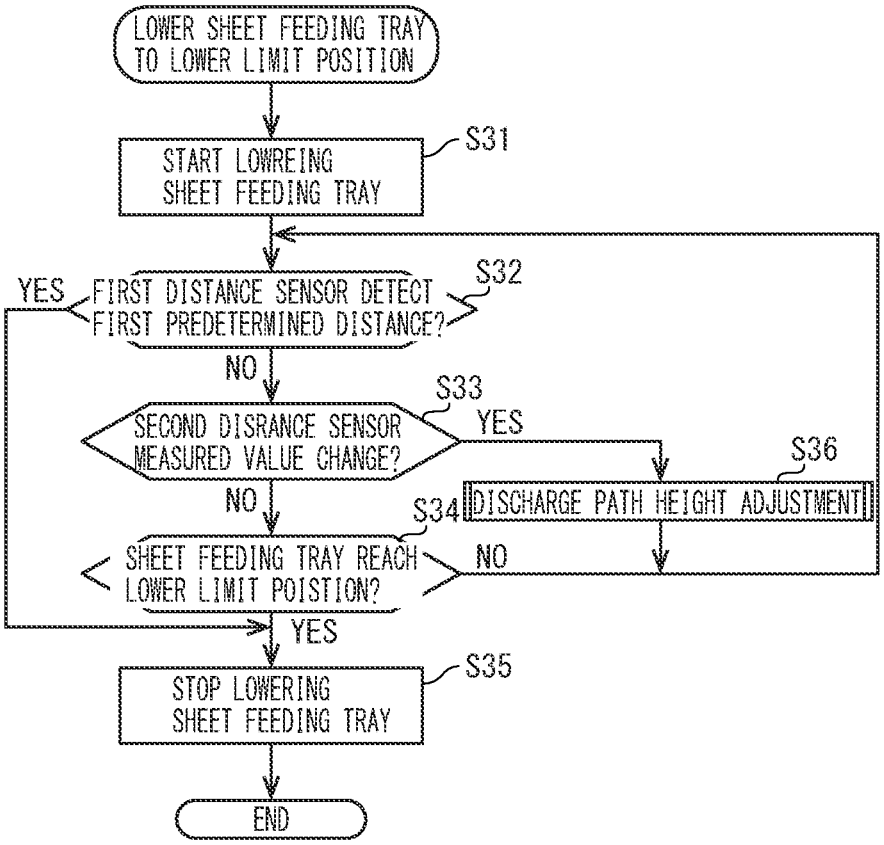
FIG. 9 is a flowchart showing an operation to lower the sheet feeding tray to a lower limit position, according to the embodiment of the present invention.

FIG. 9 is a flowchart showing the operation of lowering the sheet feeding tray 44 to the lower limit position (step S03 in FIG. 7). First, the control part 10 controls the lifting mechanism 38 to start the lowering of the sheet feeding tray 44 (step S31), and uses the first distance sensor 14 to determine whether the distance between the sheet feeding tray 44 and the discharge port 70 is the first predetermined distance (step S32). When it is determined that the is the first predetermined distance (step S31: YES), the control part 10 stops the lowering of the sheet feeding tray 44 (step S35), and terminates the processing.

On the other hand, when it is determined that the distance is not the first predetermined distance (step S32: NO), the control part 10 determines whether the measured value of the second distance sensor 17 is changed (step S33). For example, the control part 10 acquires the measured value every predetermined time and stores it in the memory, and determines that the measured value is changed when the newly acquired measured value differs from the previously acquired measured value. When it is determined that the measured value is not changed (step S33: NO), the control part 10 uses the sheet feeding tray lower limit sensor 11 to determine whether the sheet feeding tray 44 reaches the lower limit position (step S34). When it is determined that the sheet feeding tray 44 does not reach the lower limit position (step S34: NO), the control part 10 repeats the processing after step S32. On the other hand, when it is determined that the sheet feeding tray 44 reaches the lower limit position (step S34: YES), the control part 10 stops the lowering of the sheet feeding tray 44 (step S35) and terminates the processing.

If it is determined in step S33 that the measured value of the second distance sensor 17 is changed (step S33: YES), the control part 10 interrupts the lowering of the sheet feeding tray 44, then executes the discharge path height adjustment (step S36), restarts the lowering of the sheet feeding tray 44, and then repeats the processing after step S32.

Figure 10:
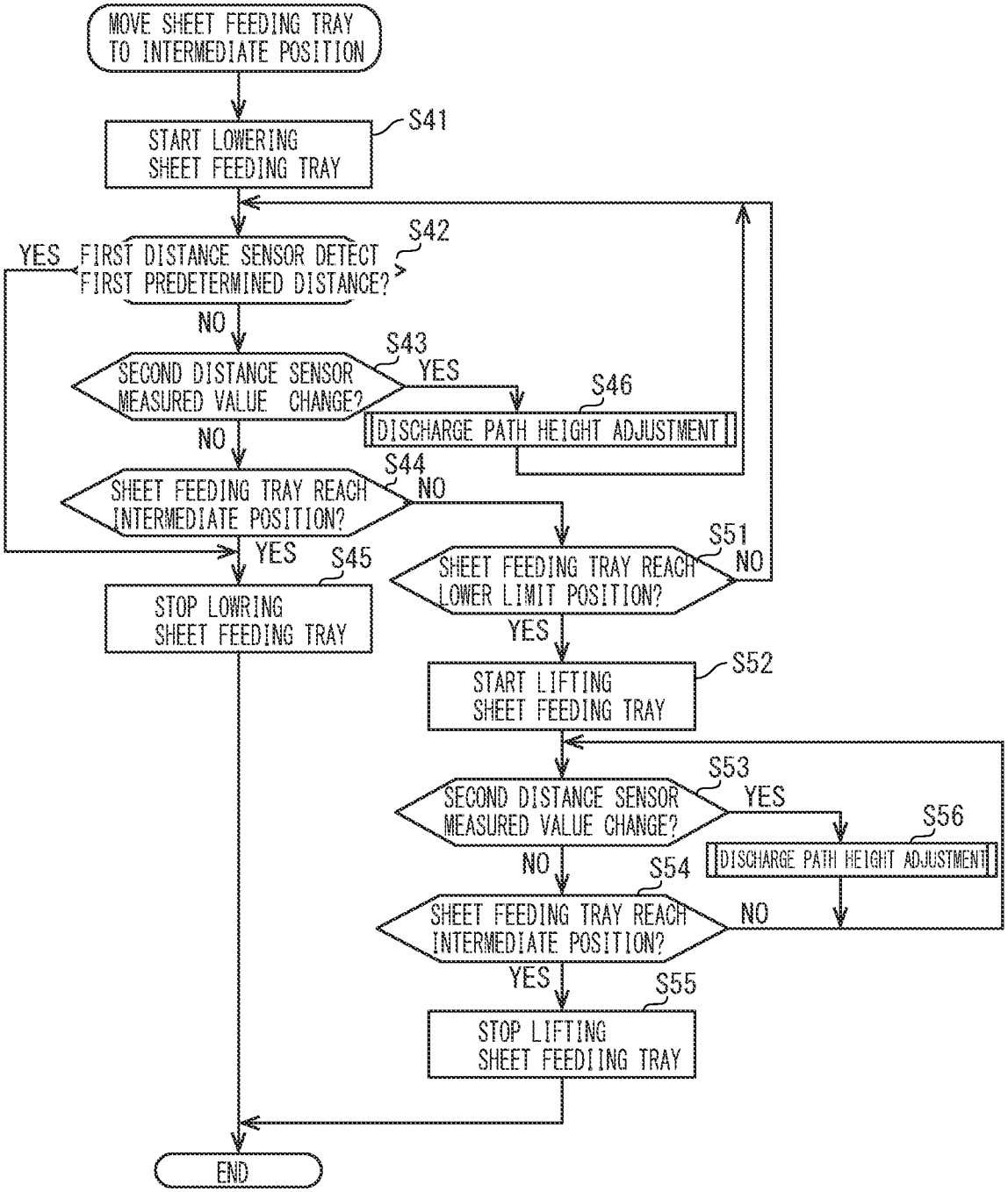
FIG. 10 is a flowchart showing an operation to move the sheet feeding tray to an intermediate position, according to the embodiment of the present invention.

FIG. 10 is a flowchart showing the operation of moving the sheet feeding tray 44 to the middle position (step S04 in FIG. 7). First, the control part 10 controls the lifting mechanism 38 to start the lowering of the sheet feeding tray 44 (step S41), and uses the first distance sensor 14 to determine whether the distance between the sheet feeding tray 44 and the discharge port 70 is the first predetermined distance (step S42). When it is determined that the distance is the first predetermined distance (step S42: YES), the control part 10 stops the lowering of the sheet feeding tray 44 (step S45), and terminates the processing.

On the other hand, when it is determined that the distance is not the first predetermined distance (step S42: NO), the control part 10 determines whether the measured value of the second distance sensor 17 is changed (step S43). When it is determined that the measured value is not changed (step S43: NO), the control part 10 uses the sheet feeding tray intermediate sensor 12 to determine whether the sheet feeding tray 44 reaches the intermediate position (step S44). When it is determined that the sheet feeding tray 44 does not reach the intermediate position (step S44: NO), the control part 10 proceeds the processing to step S51. On the other hand, when it is determined that the sheet feeding tray 44 reaches the intermediate position (step S44: YES), the control part 10 stops the lowering of the sheet feeding tray 44 (step S45), and terminates the processing.

If it is determined in step S43 that the measured value of the second distance sensor 17 is changed (step S43: YES), the control part 10 interrupts the lowering of the sheet feeding tray 44, executes the discharge path height adjustment (step S45), restarts the lowering of the sheet feeding tray 44, and then repeats the processing after step S42.

In step S51, the control part 10 uses the sheet feeding tray lower limit sensor 11 to determine whether the sheet feeding tray 44 reaches the lower limit position. When it is determined that the sheet feeding tray 44 does not reach the lower limit position (step S51: NO), the control part 10 repeats the processing after step S42. On the other hand, when it is determined that the sheet feeding tray 44 reaches the lower limit position (step S51: YES), the control part 10 controls the lifting mechanism 30 to start the lifting of the sheet feeding tray 44 (step S52).

Next, the control part 10 determines whether the measured value of the second distance sensor 17 is changed (step S53). When it is determined that the measured value is not changed (step S53: NO), the control part 10 uses the sheet feeding tray intermediate sensor 12 to determine whether the sheet feeding tray 44 reaches the intermediate position (step S54). When it is determined that the sheet feeding tray 44 does not reach the intermediate position (step S54: NO), the control part 10 repeats the processing after step S53. On the other hand, when it is determined that the sheet feeding tray 44 reaches the intermediate position (step S54: YES), the control part 10 stops the lifting of the sheet feeding tray 44 (step S55), and terminates the processing.

When it is determined in step S53 that the measured value of the second distance sensor 17 is changed (step S53: YES), the control part 10 interrupts the lifting of the sheet feeding tray 44, executes the discharge path height adjustment (step S56), lifts the sheet feeding tray 44, and repeats the processing after step S53.

Figure 11:
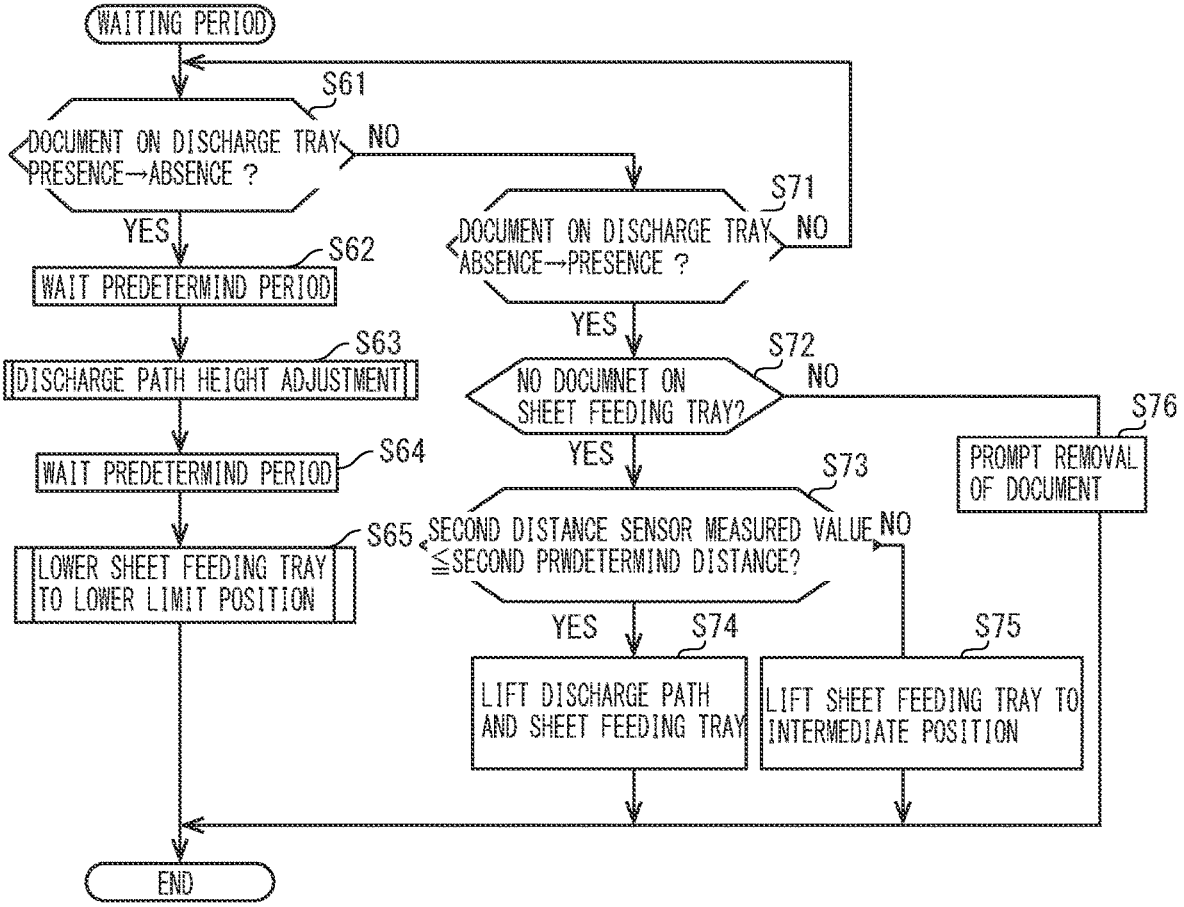
FIG. 11 is a flowchart showing a main operation of the document conveying device according to the embodiment of the present invention, in a waiting period.

FIG. 11 is a flowchart showing the main operation of the document conveying device 9 in a waiting period. The waiting period refers to a state in which the document G is not being read and a job of document reading is waiting. First, the control part 10 determines whether the discharge tray 43 is changed from a state in which the document G is stacked on the discharge tray 43 to a state in which no document G is stacked on the discharge tray 43 (step S61). Specifically, the change from the state in which the document G is stacked on the discharge tray 43 to the state in which no document G is stacked on the discharge tray 43 occurs when the user removes the document G from the discharge tray 43. The control part 10 acquires the value of the discharge tray document detection signal every prescribed time and stores it in the memory, and determines that the state is changed from the state where the document G is stacked to the state where no document G is stacked when the previously acquired value is 0 and the newly acquired value is 1.

When it is determined that it is changed from the state where the document G is stacked to the state where no document S is stacked (step S61: YES), the control part 10 waits for a predetermined time (for example, 500 msec) (step S62), and then executes the discharge path height adjustment (step S63). Then, after waiting for the predetermined time (for example, 500 msec) (step S64), the control part 10 executes the processing of lowering the sheet feeding tray 44 to the lower limit position (see FIG. 9) and ends the processing.

On the other hand, when it is determined that there is no change from the state where the document G is stacked on the discharge tray 43 to the state where no document G is stacked (step S61: NO), the control part 10 determines whether there is the change from the state where no document G is stacked on the discharge tray 43 to the state where the document G is stacked (step S71). The change from the state where no document G is stacked on the discharge tray 43 to the state where the document G is stacked occurs when the user returns all or part of the documents G removed from the discharge tray 43 to the discharge tray 43 again. When it is determined that there is no change from the state where no document G is stacked to the state where the document G is stacked (step S71: NO), the control part 10 repeats the processing after step S61.

On the other hand, when it is determined that there is the change from the state where no document G is stacked to the state where the document G is stacked (step S71: YES), the control part 10 uses the sheet feeding tray document sensor 19 to determine whether there is the document G on the sheet feeding tray 44 (step S72). If the document G is not detected by the sheet feeding tray document sensor 19, the control part 10 determines that there is no document G on the sheet feeding tray 44 (step S72: YES), and determines whether the measured value of the second distance sensor 17 is equal to or smaller than the second predetermined distance (step S73). If it is determined that the measured value of the second distance sensor 17 is equal to or smaller than the second predetermined distance (step S73: YES), the discharge path 65 is moved upward until the measured value of the second distance sensor 17 is greater than the second predetermined distance, and the sheet feeding tray 44 is moved upward until the first distance sensor 14 detects that the distance between the sheet feeding tray 44 and the discharge port 70 is the first predetermined distance (step S74). On the other hand, when it is determined that the measured value of the second distance sensor 17 is not smaller than the second predetermined distance (step S73: NO), the sheet feeding tray 44 is lifted until the sheet feeding tray 44 is detected by the sheet feeding tray intermediate sensor 12.

If the document G is detected by the sheet feeding tray document sensor 19 in step S72, the control part 10 determines that there is the document G on the sheet feeding tray 44 (step S72: NO). In this case, since it is impossible to lift the discharge path 65, the control part 10 outputs information prompting the removal of the documents G from the sheet feeding tray 44 and the discharge tray 43.

The document conveying device 9 according to the present embodiment, described above, includes: the sheet feeding tray 44 on which the document G is placed; the discharge tray 43 provided below the sheet feeding tray 44; the feeding roller 51 which feeds the document G one by one from the sheet feeding tray 44; the conveying mechanism 35 which conveys the document G from the sheet feeding tray 44 to the discharge tray 43 via the reading position; the lifting mechanism 38 which lifts and lowers the sheet feeding tray 44; the discharge tray document sensor 18 which detects the document on the discharge tray 43; and the control part 10 which controls the lifting mechanism 38 such that the upper surface of the document G placed on the sheet feeding tray 44 is pressed against the feeding roller 51 when the conveying mechanism 35 conveys the document G. The control part 10 controls the lifting mechanism 38 to lower the sheet feeding tray 44 by a larger amount in the case where the document G is not detected by the discharge tray document sensor 18 when the power is turned on than the case where the document G is detected by the discharge tray document sensor 18 (see FIG. 7). According to the configuration, it becomes possible to utilize the capacity of the sheet feeding tray 44 effectively depending on the presence and absence of the document G on the discharge tray 43.

The document conveying device 9 according to the present embodiment includes the sheet feeding tray lower limit sensor 11 which detects the sheet feeding tray 44 at the lower limit position of the sheet feeding tray 44, wherein the control part 10 controls the lifting mechanism 38 to lower the sheet feeding tray 44 until the sheet feeding tray 44 is detected by the sheet feeding tray lower limit sensor 11 in the case where the document G is not detected by the discharge tray document sensor 18 when the power is tuned on (see FIG. 7). According to the embodiment, the capacity of the sheet feeding tray 44 can be utilized maximally in the case where the document G is not stacked on the discharge tray 43.

The document conveying device 9 according to the embodiment includes the sheet feeding tray intermediate sensor 12 which detects the sheet feeding tray 44 at the intermediate position between the lower limit position and the upper limit position of the sheet feeding tray 44, wherein the control part 10 controls the lifting mechanism 38 to lift or lower the sheet feeding tray 44 such that the sheet feeding tray 44 is detected by the sheet feeding tray intermediate sensor 12 in the case where the document G is detected by the discharge tray document sensor 18 when the power is turned on (see FIG. 7). According to the embodiment, in the case where the document G is stacked on the discharge tray 43, the easiness of removing the document G from the discharge tray 43 and the effective use of the capacity of the sheet feeding tray 44 can be made compatible.

In the document conveying device 9 according to the embodiment, the conveying mechanism 35 includes: the conveyance path 61 passing through the reading position; the discharge path 65 connected to the downstream end of the conveyance path 61 in a conveyance direction; the discharge port 70 provided at the downstream end of the discharge path 65 in the conveyance direction; and the turning mechanism 37 which turns the discharge path 65 in the upper-and-lower direction around the upstream end of the discharge path 65 in the conveyance direction. The document conveying device 9 includes the first distance sensor 14 which detects that the distance between the sheet feeding tray 44 and the discharge port 70 is the first predetermined distance. In the case where the first distance sensor 14 detects that the distance between the sheet feeding tray 44 and the discharge port 70 is the first predetermined distance during lowering of the sheet feeding tray 44 by the lifting mechanism 38, the control part 10 stops the lowering of the sheet feeding tray 44 (see FIG. 9 and FIG. 10). According to the embodiment, it becomes possible to prevent interference between the sheet feeding tray 44 and the discharge port 70 during the lowering of the sheet feeding tray 44.

The document conveying device 9 according to the embodiment includes the second distance sensor 17 which measures the distance between the upper surface of the document G stacked on the discharge tray 43 and the discharge port 70. In the case where the distance detected by the second distance sensor 17 is changed during the lowering of the sheet feeding tray 44 by the lifting mechanism 38, the control part 10 stops the lowering of the sheet feeding tray 44, then controls the turning mechanism 37 to adjust the height of the discharge path 65 according to the distance detected by the second distance sensor 17, and then controls the lifting mechanism 38 to adjust the height of the sheet feeding tray 44 such that the first distance sensor 14 detects that the distance between the sheet feeding tray 44 and the discharge port 70 is the first predetermined distance (see FIG. 8, FIG. 9 and FIG. 10). According to the configuration, it becomes possible to adjust the height of the discharge path 65 and the sheet feeding tray 44 correctly in the case where the amount of the documents G on the discharge tray 43 is changed during the lowering of the sheet feeding tray 44.

According to the document conveying device 9 according to the embodiment, in the case where the document G is detected by the discharge tray document sensor 18 during the waiting period and then the document G is no longer detected by the discharge tray document sensor 18, after a predetermined time elapses, the control part 10 controls the lifting mechanism 38 to lower the sheet feeding tray 44 until the sheet feeding tray 44 is detected by the feeding tray lower limit sensor 11 (see FIG. 11). According to the configuration, it is possible to prevent the user's hand from touching the sheet feeding tray 44 by lowering the sheet feeding tray 44.

The document conveying device 9 according to the embodiment includes the discharge path lower limit sensor 16 which detects the discharge path 65 at the lower limit position of the discharge path 65. In the case where the measured value of the second distance sensor 17 is longer than the second predetermined distance when the power is turned on or when the reading is end, the control part 10 controls the turning mechanism 37 to lower the discharge path 65 until the discharge path lower limit sensor 16 detects the discharge path 65 (see FIG. 8). According to the configuration, when the discharge port 70 is higher than the proper height, the height of the discharge port 70 can be adjusted again and then the height of the sheet feeding tray 44 can be adjusted.

According to the document conveying device 9 according to the embodiment, in the case where the measured value of the second distance sensor 17 is less than the second predetermined distance during the lowering of the sheet feeding tray 44 by the lifting mechanism 38, the control part 10 stops the lowering of the sheet feeding tray 44 (see FIG. 8). According to the configuration, when the discharge port 70 is higher than the proper height, the height of the discharge port 70 can be adjusted again and then the height of the sheet feeding tray 44 can be adjusted.

According to the document conveying device 9 according to the embodiment, the control part 10 controls the turning mechanism 37 to lift the discharge path 65 until the measured value of the second distance sensor 17 is larger than the second predetermined distance in the case where the distance detected by the second distance sensor 17 is shorter than the second predetermined distance when the power is turned on or when the reading is end (see FIG. 8). According to the embodiment, when the discharge port 70 is higher than the proper height, the height of the discharge port 70 can be adjusted again and then the height of the sheet feeding tray 44 can be adjusted.

According to the document conveying device 9 according to the embodiment, in the case where the first distance sensor 14 detects that the distance between the sheet feeding tray 44 and the discharge port 70 is the first predetermined distance during the lifting of the discharge path 65 by the turning mechanism 37, the control part 10 stops the lifting of the discharge path 65 and outputs the information to prompt the removal of the documents G (see FIG. 8). According to the configuration, the capacity of the sheet feeding tray 44 can be utilized effectively be removing the documents G.

According to the document conveying device 9 according to the embodiment, in the case where the document G is detected by the discharge tray document sensor 18 during the waiting period and then the document G is no longer detected by the discharge tray document sensor 18, after a predetermined period of time elapses, the control part 10 controls the turning mechanism 37 to lower the discharge path 65 until the discharge path 65 is detected by the discharge path lower limit sensor 16, and then controls the lifting mechanism 38 to lower the sheet feeding tray 44 until the sheet feeding tray 44 is detected by the sheet feeding tray lower limit sensor 11 (see FIG. 11). According to the configuration, it is possible to prevent the user's hand from touching the sheet feeding tray 44 by lowering the sheet feeding tray 44 after the discharge path 65 is lowered.

According to the document conveying device 9 according to the embodiment, in the case where the document G is not detected by the discharge tray document sensor 18 during the waiting period, the document G is then detected by the discharge tray document sensor 18 and the document G is not detected by the sheet feeding tray document sensor 19, the control part 10 controls the lifting mechanism 38 to position the sheet feeding tray 44 according to an amount of the document stacked on the discharge tray 43 (see FIG. 11). According to the configuration, it becomes possible to utilize the capacity of the sheet feeding tray 44 effectively depending on the presence and absence of the document G on the discharge tray 43.

According to the document conveying device 9 according to the embodiment, in the case where the document G is not detected by the discharge tray document sensor 18 during the waiting period, the document G is then detected by the discharge tray document sensor 18, the document G is not detected by the sheet feeding tray document sensor 19, and the measured value of the second distance sensor 17 is smaller than the second predetermined distance, the control part 10 controls the turning mechanism 37 to lift the discharge path 65 until the measured value of the second distance sensor 17 is larger than the second predetermined distance, and controls the lifting mechanism 38 to lift the sheet feeding tray 44 until the first distance sensor 14 detects that the distance between the sheet feeding tray 44 and the discharge port 70 is the first predetermined distance (see FIG. 11). According to the configuration, it becomes possible to position the discharge path 65 and the sheet feeding tray 44 at proper height when the document G is placed on the discharge tray 43 again during the waiting period.

According to the document conveying device 9 according to the embodiment, in the case where the document G is not detected by the discharge tray document sensor 18 during the waiting period, the document G is then detected by the discharge tray document sensor 18, the document G is not detected by the sheet feeding tray document sensor 19, and the measured value of the second distance sensor 17 is larger than the second predetermined distance, the control part 10 controls the lifting mechanism 38 to lift the sheet feeding tray 44 until the sheet feeding tray intermediate sensor 12 detects the sheet feeding tray 44 (see FIG. 11). According to the configuration, it becomes possible to position the discharge path 65 and the sheet feeding tray 44 at proper height when a small amount of the document G is placed on the discharge tray 43 again during the waiting period.

According to the document conveying device 9 according to the embodiment, in the case where the document G is not detected by the discharge tray document sensor 18 during the waiting period, the document G is then detected by the discharge tray document sensor 18 and the sheet feeding tray document sensor 19, the control part 10 outputs information to prompt removal of the document G (see FIG. 11). According to the configuration, it becomes possible to utilize the capacity of the sheet feeding tray 33 by removing the document G.

The invention claimed is:

1. A document conveying device comprising:

a sheet feeding tray on which a document is placed;

a discharge tray provided below the sheet feeding tray;

a feeding roller which feeds the document one by one from the sheet feeding tray;

a conveying mechanism which conveys the document from the sheet feeding tray to the discharge tray via a reading position;

a lifting mechanism which lifts and lowers the sheet feeding tray;

a discharge tray document sensor which detects the document on the discharge tray;

a sheet feeding tray lower limit sensor which detects the sheet feeding tray at a lower limit position of the sheet feeding tray; and a control part which controls the lifting mechanism such that an upper surface of the document placed on the sheet feeding tray is pressed against the feeding roller when the conveying mechanism conveys the document, wherein the control part controls the lifting mechanism to lower the sheet feeding tray by a larger amount in a case where the document is not detected by the discharge tray document sensor when power is turned on than a case where the document is detected by the discharge tray document sensor, and the control part controls the lifting mechanism to lower the sheet feeding tray until the sheet feeding tray is detected by the sheet feeding tray lower limit sensor in the case where the document is not detected by the discharge tray document sensor when the power is tuned on.

2. The document conveying device according to claim 1, wherein the conveying mechanism includes:

a conveyance path passing through the reading position;

a discharge path connected to a downstream end of the conveyance path in a conveyance direction;

a discharge port provided at a downstream end of the discharge path in the conveyance direction; and a turning mechanism which turns the discharge path in an upper-and-lower direction around an upstream end of the discharge path in the conveyance direction, the document conveying device comprises a first distance sensor which detects that a distance between the sheet feeding tray and the discharge port is a first predetermined distance, and in a case where the first distance sensor detects that the distance between the sheet feeding tray and the discharge port is the first predetermined distance during lowering of the sheet feeding tray by the lifting mechanism, the control part stops the lowering of the sheet feeding tray.

3. The document conveying device according to claim 2, comprising:

a second distance sensor which measures a distance between an upper surface of the document stacked on the discharge tray and the discharge port, wherein in a case where the distance detected by the second distance sensor is changed during the lowering of the sheet feeding tray by the lifting mechanism, the control part stops the lowering of the sheet feeding tray, then controls the turning mechanism to adjust a height of the discharge path according to the distance detected by the second distance sensor, and then controls the lifting mechanism to adjust a height of the sheet feeding tray such that the first distance sensor detects that the distance between the sheet feeding tray and the discharge port is the first predetermined distance.

4. The document conveying device according to claim 2, comprising:

a discharge path lower limit sensor which detects the discharge path at a lower limit position of the discharge path, wherein in a case where a measured value of the second distance sensor is longer than the second predetermined distance when the power is turned on or when a reading is end, the control part controls the turning mechanism to lower the discharge path until the discharge path lower limit sensor detects the discharge path.

5. The document conveying device according to claim 4, wherein in a case where the measured value of the second distance sensor is less than the second predetermined distance during the lowering of the sheet feeding tray by the lifting mechanism, the control part stops the lowering of the sheet feeding tray.

6. The document conveying device according to claim 4, wherein in a case where the document is detected by the discharge tray document sensor during the waiting period and then the document is no longer detected by the discharge tray document sensor, after a predetermined period of time elapses, the control part controls the turning mechanism to lower the discharge path until the discharge path is detected by the discharge path lower limit sensor, and then controls the lifting mechanism to lower the sheet feeding tray until the sheet feeding tray is detected by the sheet feeding tray lower limit sensor.

7. The document conveying device according to claim 2, wherein in a case where the distance detected by the second distance sensor is shorter than the second predetermined distance when the power is turned on or when the reading is end, the control part controls the turning mechanism to lift the discharge path until the measured value of the second distance sensor is larger than the second predetermined distance.

8. The document conveying device according to claim 7, wherein in a case where the first distance sensor detects that the distance between the sheet feeding tray and the discharge port is the first predetermined distance during the lifting of the discharge path by the turning mechanism, the control part stops the lifting of the discharge path and outputs information to prompt removal of the documents.

9. A document conveying device comprising:

a sheet feeding tray on which a document is placed;

a discharge tray provided below the sheet feeding tray;

a feeding roller which feeds the document one by one from the sheet feeding tray;

a conveying mechanism which conveys the document from the sheet feeding tray to the discharge tray via a reading position;

a lifting mechanism which lifts and lowers the sheet feeding tray;

a discharge tray document sensor which detects the document on the discharge tray;

a sheet feeding tray intermediate sensor which detects the sheet feeding tray at an intermediate position between a lower limit position and an upper limit position of the sheet feeding tray; and a control part which controls the lifting mechanism such that an upper surface of the document placed on the sheet feeding tray is pressed against the feeding roller when the conveying mechanism conveys the document, wherein the control part controls the lifting mechanism to lower the sheet feeding tray by a larger amount in a case where the document is not detected by the discharge tray document sensor when power is turned on than a case where the document is detected by the discharge tray document sensor, and the control part controls the lifting mechanism to lift or lower the sheet feeding tray such that the sheet feeding tray is detected by the sheet feeding tray intermediate sensor in the case where the document is detected by the discharge tray document sensor when the power is turned on.

10. A document conveying device comprising:

a sheet feeding tray on which a document is placed;

a discharge tray provided below the sheet feeding tray;

a feeding roller which feeds the document one by one from the sheet feeding tray;

a conveying mechanism which conveys the document from the sheet feeding tray to the discharge tray via a reading position;

a lifting mechanism which lifts and lowers the sheet feeding tray;

a discharge tray document sensor which detects the document on the discharge tray;

a sheet feeding tray lower limit sensor which detects the sheet feeding tray at a lower limit position of the sheet feeding tray; and a control part which controls the lifting mechanism such that an upper surface of the document placed on the sheet feeding tray is pressed against the feeding roller when the conveying mechanism conveys the document, wherein the control part controls the lifting mechanism to lower the sheet feeding tray by a larger amount in a case where the document is not detected by the discharge tray document sensor when power is turned on than a case where the document is detected by the discharge tray document sensor, and in a case where the document is detected by the discharge tray document sensor during a waiting period and then the document is no longer detected by the discharge tray document sensor, after a predetermined time elapses, the control part controls the lifting mechanism to lower the sheet feeding tray until the sheet feeding tray is detected by the feeding tray lower limit sensor.

11. A document conveying device comprising:

a sheet feeding tray on which a document is placed;

a discharge tray provided below the sheet feeding tray;

a feeding roller which feeds the document one by one from the sheet feeding tray;

a conveying mechanism which conveys the document from the sheet feeding tray to the discharge tray via a reading position;

a lifting mechanism which lifts and lowers the sheet feeding tray;

a discharge tray document sensor which detects the document on the discharge tray;

a sheet feeding tray document sensor which detects the document on the sheet feeding tray; and a control part which controls the lifting mechanism such that an upper surface of the document placed on the sheet feeding tray is pressed against the feeding roller when the conveying mechanism conveys the document, wherein the control part controls the lifting mechanism to lower the sheet feeding tray by a larger amount in a case where the document is not detected by the discharge tray document sensor when power is turned on than a case where the document is detected by the discharge tray document sensor, and in a case where the document is not detected by the discharge tray document sensor during a waiting period, the document is then detected by the discharge tray document sensor and the document is not detected by the sheet feeding tray document sensor, the control part controls the lifting mechanism to position the sheet feeding tray according to an amount of the document stacked on the discharge tray.

12. The document conveying device according to claim 11, wherein the conveying mechanism includes:

a conveyance path passing through the reading position;

a discharge path connected to a downstream end of the conveyance path in a conveyance direction;

a discharge port provided at a downstream end of the discharge path in the conveyance direction; and a turning mechanism which turns the discharge path in an upper-and-lower direction around an upstream end of the discharge path in the conveyance direction, the document conveying device comprises:

a first distance sensor which detects that a distance between the sheet feeding tray and the discharge port is a first predetermined distance; and a second distance sensor which measures a distance between an upper surface of the document stacked on the discharge tray and the discharge port, wherein in a case where the document is not detected by the discharge tray document sensor during the waiting period, the document is then detected by the discharge tray document sensor, the document is not detected by the sheet feeding tray document sensor, and the measured value of the second distance sensor is smaller than the second predetermined distance, the control part controls the turning mechanism to lift the discharge path until the measured value of the second distance sensor is larger than the second predetermined distance, and controls the lifting mechanism to lift the sheet feeding tray until the first distance sensor detects that the distance between the sheet feeding tray and the discharge port is the first predetermined distance.

13. The document conveying device according to claim 11, wherein the conveying mechanism includes:

a conveyance path passing through the reading position;

a discharge path connected to a downstream end of the conveyance path in a conveyance direction;

a discharge port provided at a downstream end of the discharge path in the conveyance direction; and a turning mechanism which turns the discharge path in an upper-and-lower direction around an upstream end of the discharge path in the conveyance direction, the document conveying device comprises:

a second distance sensor which measures a distance between an upper surface of the document stacked on the discharge tray and the discharge port; and a sheet feeding tray intermediate distance sensor which detects the sheet feeding tray at an intermediate position between the lower limit position and an upper limit position of the sheet feeding tray, wherein in a case where the document is not detected by the discharge tray document sensor during the waiting period, the document is then detected by the discharge tray document sensor, the document is not detected by the sheet feeding tray document sensor, and the measured value of the second distance sensor is larger than the second predetermined distance, the control part controls the lifting mechanism to lift the sheet feeding tray until the sheet feeding tray intermediate sensor detects the sheet feeding tray.

14. The document conveying device according to claim 11, wherein in a case where the document is not detected by the discharge tray document sensor during the waiting period, the document is then detected by the discharge tray document sensor and the sheet feeding tray document sensor, the control part outputs information to prompt removal of the document.

* * * * *